US007448329B2

(12) United States Patent
Muller et al.

(10) Patent No.: US 7,448,329 B2
(45) Date of Patent: Nov. 11, 2008

(54) WHEEL SET GUIDANCE ASSEMBLY

(75) Inventors: Detlef Muller, Siegen (DE); Gehard Kampmann, Nephen (DE); Guido Bieker, Kirchhundem (DE)

(73) Assignee: Bombardier Transportation GmbH, Berlin (DE)

( * ) Notice: Subject to any disclaimer, the term of this patent is extended or adjusted under 35 U.S.C. 154(b) by 141 days.

(21) Appl. No.: 10/538,919

(22) PCT Filed: Dec. 12, 2003

(86) PCT No.: PCT/EP03/14159

§ 371 (c)(1),
(2), (4) Date: Jan. 13, 2006

(87) PCT Pub. No.: WO2004/054865

PCT Pub. Date: Jul. 1, 2004

(65) Prior Publication Data

US 2006/0230976 A1 Oct. 19, 2006

(30) Foreign Application Priority Data

Dec. 13, 2002 (GB) ..... 0229046.8

(51) Int. Cl.
*B61F 5/00* (2006.01)

(52) U.S. Cl. ..... 105/224.05; 105/224.1

(58) Field of Classification Search ..... 105/218.1, 105/218.2, 219, 220, 221.1, 222, 223, 224.05, 105/224.06, 224.1
See application file for complete search history.

(56) References Cited

U.S. PATENT DOCUMENTS

| | | | | |
|---|---|---|---|---|
| 4,109,586 | A * | 8/1978 | Briggs et al. | 105/224.06 |
| 5,001,989 | A | 3/1991 | Mulcahy et al. | |
| 5,909,711 | A * | 6/1999 | Vogel et al. | 105/168 |

FOREIGN PATENT DOCUMENTS

| | | | |
|---|---|---|---|
| DE | 26 44 964 | * | 4/1978 |
| DE | 4141463 | A | 12/1991 |
| DE | 4315568 | A | 5/1993 |
| EP | 0073119 | A | 3/1983 |
| EP | 0624505 | A | 11/1994 |
| GB | 1037298 | A | 7/1966 |
| GB | 1265642 | A | 3/1972 |
| GB | 1582697 | A | 7/1977 |
| GB | 1532495 | A | 11/1978 |
| GB | 2144693 | A | 3/1985 |
| JP | 3-258656 | * | 3/1991 |

OTHER PUBLICATIONS

International Search Report (PCT/EP03/14159), Mar. 5, 2004.

* cited by examiner

*Primary Examiner*—Mark T Le
(74) *Attorney, Agent, or Firm*—David P. Owen; Jacobus C. Rassen; Howery LLP

(57) ABSTRACT

A wheel set guidance assembly is provided for suspending a wheel set bearing (10) of a wheel set (20) to a bogie frame (30), comprising separate vertical (50), lateral (70) and longitudinal (40) guidance elements for independent guidance of the movement of the wheel set in vertical, lateral and longitudinal directions wherein the stiffness of the guidance elements can be selected independently of each other.

12 Claims, 2 Drawing Sheets

WHEEL SET GUIDANCE ASSEMBLY

BACKGROUND OF THE INVENTION

1. Field of the Invention

The present invention relates to a wheel set guidance assembly for suspending a wheel set bearing of a wheel set to a bogie frame. The invention further relates to a bogie, in particularly to a train bogie, comprising such a wheel set guidance assembly and a method for providing a bogie with optimal wheel set guidance.

2. Description of the Related Art

DE 41 41 463 describes a wheel set guidance assembly for a train bogie in which a coil spring is arranged on top of the wheel set bearing for carrying the bogie frame and in which the wheel set bearing is further attached to the bogie frame by a rigid steering arm longitudinally extending from the wheel set bearing to a console rigidly mounted on the bogie frame. Metal-rubber elements are arranged between the steering arm and the bogie frame guidance console. For the purposes of this specification, the longitudinal, lateral and vertical directions are references to the respective directions relative to the bogie.

DE 43 15 568 describes a wheel set guidance assembly consisting of two coil springs for the vertical suspension and guidance and rubber elements engaging a guidance pin to take over both longitudinal and lateral guidance of the wheel-set.

One problem of the known wheel set guidance assemblies is that they are not easily adaptable to specific rail networks and that an optimum guidance of the wheel set often cannot be achieved. This problem occurs in particular in bogies that have to rum in different networks with a specific portion of highly demanding tracks having, for example, narrow curves. A guidance assembly that is not optimised can cause undesirable wear of the wheels, noise, passenger discomfort because of undesired movements of the car body, and more importantly a risk of derailment.

A further problem of the prior art wheel guidance assemblies is that the rail tracking forces that occur during driving, in particular on curved tracks, are for a large part carried by the longitudinal beams of the bogie frame. These beams keep the wheel set guidance elements, spring, dampers and other components in position. The stiffness of the bogie frame must be designed to accommodate such forces. Prior art bogie frames, designed for use in a variety of situations, are typically over-designed to meet all stiffness requirements and are hence undesirably heavy.

Accordingly, there is a particular need for an improved wheel set guidance assembly. Preferably, such an improved assembly would be compact, to allow for a low bogie construction and a low car body floor,

BRIEF SUMMARY OF THE INVENTION

According to the present invention there is provided a wheel set guidance assembly comprising individual vertical-, lateral and longitudinal guidance elements for independent guidance of the movement of the wheel set in vertical, lateral and longitudinal directions, wherein the stiffness of the guidance elements can be selected independently of each other.

In contrast to the known guidance assemblies, the assembly of the present invention offers a comprehensive scheme of wheel set guidance means, which can easily be adapted to the specific circumstances and needs of different rail networks. Thus an optimum running behaviour with regard to safety, comfort and wear can easily be achieved covering a wide range of operating conditions with the same basic bogie arrangement. It has been found that the wheel set guidance assembly according to the present invention can meet the high requirements for stability and curve guidance, as well as for safety against derailing over a wide range of applications of the bogie.

GB 1 532 495 describes a wheel set guidance comprising traction bars for longitudinal guidance and, for the vertical guidance, a suspension coil comprising within the coil a stack of metal-rubber discs and a rubber plug to modify the vertical suspension properties. The wheel set guidance further comprises means to limit lateral movement of the bogie frame relative to the wheel set and means to reduce wear from lateral movements. The means to limit lateral movement comprise control fingers on the frame extending into slots on the saddle and a rib and channel construction allowing a rib and saddle rocking of the saddle relative to the frame. The means to reduce wear from lateral movement comprise a wedge-shaped element fitted with friction wear-plates (24) which are pressed by a spring force to the axle journal housing, thus producing a constant friction force acting against lateral movements. Although lateral movement is restricted by the mentioned elements, the stiffness in lateral direction depends on several hard ware elements and also on the spring properties and hence cannot be cannot be chosen independently from the stiffness in the other directions with an easy adaptation to adjust to different network conditions.

GB 1 582 697 describes the problem of easy adaptation of spring constants in vertical, horizontal longitudinal and horizontal transverse directions and a solution wherein at least in two of the three directions torsion bars are provided, the rigidity of which can be adjusted by appropriate selection or by shiftable transmission levers. A principal property of the torsion bar is the dependency of their torsional stiffness from their bending stiffness. Since the torsion bars are considerably loaded by a bending moment during movements in a direction, which is orthogonal to their direction of operation, this loading determines the dimensioning of the respective torsion bars limiting the freedom of adjusting the desired spring constant. The stiffness in any of the three different dimensions cannot be chosen independently from the stiffness in the other dimensions, making the adaptation to different network conditions more difficult.

BRIEF DESCRIPTION OF THE DRAWINGS

An embodiment of the guidance assembly of the present invention will now be described, by way of example only, with reference to the accompanying drawings, in which.

DESCRIPTION OF ILLUSTRATIVE EMBODIMENTS

Figure 1:
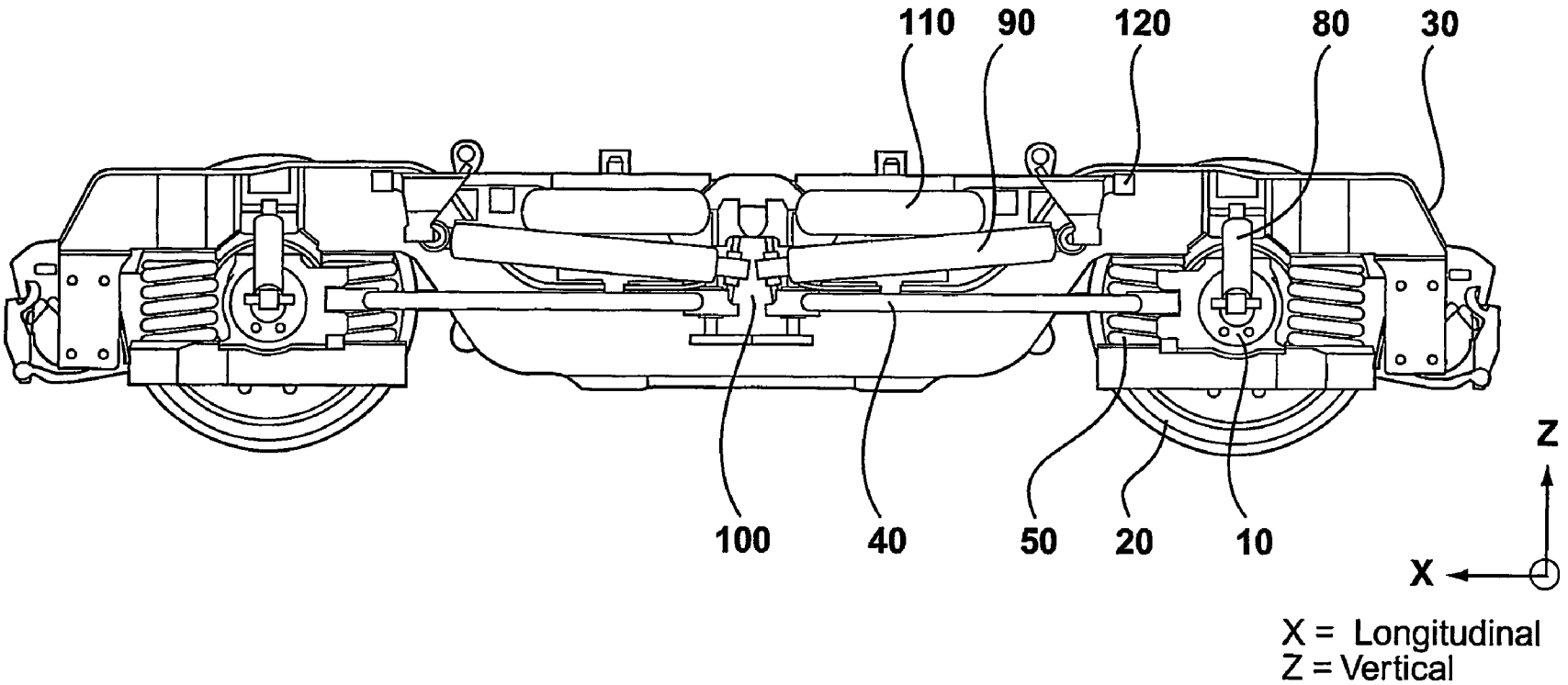
FIG. 1 is a schematic representation of a bogie comprising one embodiment of a wheel set guidance assembly according to the present invention.
Figure 2:
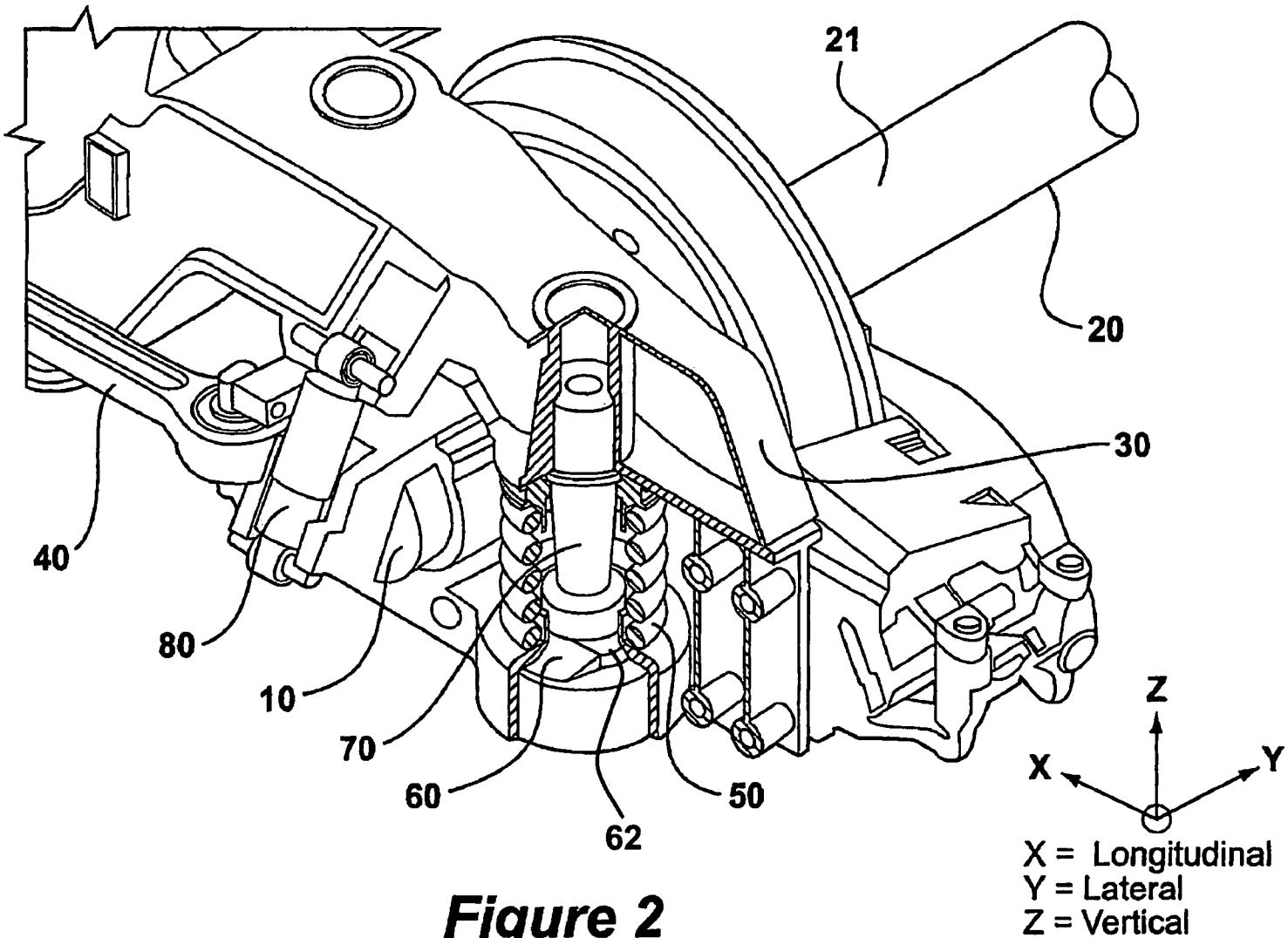
FIG. 2 is a schematic representation of a single wheel set guidance assembly of the embodiment of FIG. 1 in partial cross-section and showing the vertical and lateral guidance elements.

In FIGS. 1 and 2 a preferred embodiment of the wheel set guidance assembly of the present invention is shown, located in a bogie for a rail vehicle. Referring to FIG. 1, a rail bogie has a bogie frame (30) of largely conventional design. The bogie frame (30) is supported at each end by a wheel set assembly. The two wheel set assemblies shown are identical. For clarity and ease of reference the details of just one assembly is shown in FIG. 2 and described hereafter.

The wheel set comprises a pair of wheels mounted on either end of an axle (not shown) in conventional manner and running on a set of rails (not shown). Each end of the axle runs in a wheel set bearing (10) suspended by a wheel set guidance. The wheel set bearing shown has a housing shaped with horizontal extensions in longitudinal direction on both sides of the axle position to support the lower end of the springs (50) and means for attaching the longitudinal and lateral guidance elements (not shown).

In FIG. 1, a longitudinally arranged wheel set linkage bar (40) acts as a longitudinal guidance element and flexibly connects the bogie frame (30) and the wheel set bearing (10) to allow guidance of a turning movement of the wheel set (20) on curved tracks. The longitudinal linkage bar (40) has a length extending towards a centre bogie console (100) in the longitudinal centre position of the bogie frame (30). With centre bogie console is meant a centre part of the bogie provided with protruding connection means for both sides of the bogie. The wheel set linkage bar (40) is preferably connected to the longitudinal inward position of the wheel set bearing with flexible couplings on either side, preferably spherical couplings, for example spherical rubber couplings to provide bias. The bar itself preferably is rigid. The length of the longitudinal linkage bar (40) is preferably more than half, more preferably more than 75% of the distance between the wheel set axle position and the bogie centre position The advantage is that undesired movements of the linkages are reduced and that the longitudinal guidance forces do not have to be transmitted via the bogie frame. Preferably the wheel set linkage bar (40) is connected at about the height of the wheel set axle (21) extending essentially horizontally to connect to the centre bogie console (100).

In FIG. 1 the lateral guidance element is a spring element (60) of anisotropic stiffness engaging a guidance pin (70). As used herein, "anisotropic stiffness" is a reference to the stiffness in lateral direction being higher than the stiffness in both other perpendicular directions. The anisotropy ratio, i.e. the stiffness in lateral direction over the stiffness in the longitudinal direction can be as little as 1.1, but more often is more than 2 or even 5, depending on the specific requirements of the track.

As shown in FIG. 1, the guidance pin (70) can be rigidly mounted in the bogie frame protruding in the spring element (60) mounted on the wheel set bearing (10). In an alternative embodiment the guidance pin (70) is rigidly mounted on the wheel set bearing (10) protruding in the spring element (60) rigidly mounted in the bogie frame (30). In operation, the lateral forces generated by the lateral movement of the wheel set along curved tracks are transferred by the guidance pin (70) guided via the spring element (60) from the wheel set bearing to the bogie frame or vica versa.

The spring element (60) can be any resilient element for example a rubber-metal element with different shape or composition in lateral and longitudinal direction. Preferably, the spring element (60) comprises a rubber-metal element, for example an arcuate block having alternating rubber and metal plates, arranged in lateral direction only, thus ensuring a very low stiffness in longitudinal and vertical direction and a high stiffness in lateral direction.

The guidance in lateral direction remains substantially separate and can be chosen independently from the guidance in vertical and longitudinal directions. In the combination of a longitudinal linkage bar and anisotropic lateral guidance element as described above the stiffness in longitudinal direction can be chosen completely independently from the stiffness in lateral direction. The lateral guidance can easily be adjusted by choosing the anisotropy and stiffness of the spring element (60) in view of the specific circumstances of the track.

The vertical guidance element shown in FIGS. 1 and 2 is a vertically arranged coil spring (50) connecting the wheel set bearing (10) and the bogie frame (30). The coil spring (50) can be arranged in different ways. A single coil spring can for example be arranged on top of the wheel set bearing centred above the wheel set shaft (21). As shown in FIG. 1 and FIG. 2 the wheel set guidance preferably has two coil springs (50) on each side in longitudinal direction of the wheel set bearing and arranged next to the axle position. The lower end of the coil springs on both sides of the axle position of the wheel set bearing are preferably arranged below the level of the wheel centre, preferably lower than the axle bearing. The wheel set bearing has a housing shaped with horizontal extensions in longitudinal direction on both sides of the axle position to support the lower end of the springs. The advantage of this embodiment is that the wheel set guidance is much more compact in vertical direction allowing a lower car body floor.

The spring element (60) of anisotropic stiffness is preferably arranged above, in or below the coil spring (50) engaging the guidance pin (70) positioned inside said coil spring as shown in FIG. 2. his has the advantage of a very low construction volume.

A further advantage of the wheel set guidance having two springs is that it is possible to combine one or two lateral guidance element with the coil springs. This possibility creates a further easy and flexible possibility to optimise the wheel set guidance assembly to the requirements of a specific track. The embodiment shown in FIGS. 1 and 2 comprises two coil springs both comprising a lateral guidance element In another embodiment of the invention the wheel set guidance has only one of the two coil springs (50) combined with a lateral guidance element comprising a spring element (60) of anisotropic stiffness positioned below, in or above the coil spring and engaging a guidance pin (70) positioned inside the coil spring. Preferably this is the longitudinally inward coil spring. The use of just one guidance pin for each wheel set bearing, in combination with the connection to the bogie centre through the wheel set linkage bar, creates an additional virtual lever on the turning momentum of the wheel sets during travel in curved tracks, giving advantageous support due to aligning forces.

In a preferred embodiment of the present invention the wheel set guidance assembly has, as the longitudinal guidance element, a longitudinally arranged wheel set linkage bar (40) for connecting the bogie Same (30) and the wheel set bearing (10) flexibly to allow guidance of a turning movement of the wheel set on curved tracks, wherein the longitudinal linkage bar (40) has a length extending towards a centre bogie console (100) in the longitudinal centre position of the bogie frame (30) and, as the vertical guidance element, at least one vertically arranged coil spring (50) connecting the wheel set bearing (10) and the bogie frame (30) and, as the lateral guidance element, a spring element (60) of anisotropic stiffness engaging a guidance pin (70). Preferences for the guidance elements are described above. This embodiment has the advantage of a simple, mutually independent choice of the rigidities in each direction easily adaptable to the specific requirements of the trajectory to be driven on.

In a most preferred embodiment, the wheel set guidance further has two coil springs (50) on each side (in longitudinal direction) of the wheel set bearing with the lower ends of both spring coils being below the wheel set axle level and the upper ends supporting the bogie frame (30) and wherein the lateral guidance element is a spring element (60) engaging a guidance pin (70) both rigidly mounted opposite to each other on either the bogie frame or the wheel set bearing and arranged on, in or below one or both coil spring (50). This embodiment has the additional advantage of having a low car body floor, The invention further relates to a bogie comprising a wheel set guidance assembly as described above. Preferably, the bogie comprises two wheel sets both provided on both sides with a wheel set guidance assembly as described above. The wheel set guidance assembly is preferably used in combination with dampers to smooth and decelerate movements between the bogie and the wheel set and between the car body and the bogie. The bogie preferably comprises primary damping, for example dampers (80), connecting the wheel set bearing (10) to the bogie frame (30). Preferably the bogie further comprises yaw dampers (90) connecting on one end the centre bogie console (100) and on the other end (120) to the car body. The bogie can further comprise further functional elements, for example a secondary suspension (110) of the car body, brakes, traction power transmission elements and drive equipment The invention further relates to a method for providing a bogie with optimal wheel set guidance comprising the steps of providing a bogie comprising a wheel set guidance assembly comprising individual vertical, lateral and longitudinal guidance elements, preferably a wheel set guidance according to the invention as described above, and selecting the stiffness of each guidance element in vertical, lateral and longitudinal directions independently of the stiffness of the other guidance elements to optimise the wheel set guidance in view of the requirements of a particular application of the bogie. The advantage of the method is that is more easy and inexpensive to adapt the same bogie to meet the specific wheel guidance requirements of a wider variety of different tracks.

The invention claimed is:

1. Wheel set guidance assembly for connecting a wheel set bearing of a wheel set to a bogie frame, comprising individual vertical, lateral and longitudinal guidance elements independently guiding of the movement of the wheel set in vertical, lateral and longitudinal directions wherein the stiffness of each guidance element is selected independently of the other guidance elements, and wherein the longitudinal guidance element is a longitudinally arranged wheel set linkage bar for connecting the bogie frame and a wheel set bearing flexibly to allow guidance of a turning movement of the wheel set on curved tracks wherein the vertical guidance element is at least one vertically arranged coil spring connecting the wheel set bearing and the bogie frame and wherein the coil spring is combined with the lateral guidance element comprising a spring element of anisotropic stiffness positioned below, in or above the coil spring and engaging a guidance pin positioned inside the coil spring.

2. Wheel set guidance assembly according to claim 1, wherein the longitudinal linkage bar has a length extending towards a centre bogie console in the longitudinal centre position of the bogie frame.

3. Wheel set guidance assembly according to claim 2, wherein the wheel set linkage bar is connected to a longitudinal inward position of the wheel set bearing with a flexible coupling.

4. Wheel set guidance assembly according to claim 3, wherein the wheel set linkage bar is flexibly connected at approximately a height of a wheel set axle and extends essentially horizontally to flexibly connect to the center bogie console.

5. Wheel set guidance assembly according to claim 1, wherein the stiffness of the spring element in the lateral direction is higher than the stiffness in the longitudinal and vertical directions.

6. Wheel set guidance assembly according to claim 5, wherein the spring element comprises a rubber-metal structure arranged in lateral direction only.

7. Wheel set guidance assembly according to claim 1, wherein the guidance pin is rigidly mounted in the bogie frame protruding in the spring element rigidly mounted on the wheel set bearing.

8. Wheel set guidance assembly according to claim 1, wherein the guidance pin is rigidly mounted on the wheel set bearing protruding in the spring element rigidly mounted in the bogie frame.

9. A bogie comprising two wheel sets, each provided with a wheel set guidance assembly according to claim 1.

10. Wheel set guidance assembly according to claim 1, wherein, said as least one coil spring includes two coil springs on each side in longitudinal direction of the wheel set bearing and arranged adjacent to a wheel set axle position.

11. A bogie comprising a wheel set guidance assembly as defined in claim 1.

12. Wheel set guidance assembly for connecting a wheel set bearing of a wheel set to a bogie frame, comprising individual vertical, lateral and longitudinal guidance elements independently guiding of the movement of the wheel set in vertical, lateral and longitudinal directions wherein the stiffness of each guidance element is selected independently of the other guidance elements, wherein the lateral guidance element is a spring element of anisotropic stiffness engaging a guidance pin and wherein the vertical guidance element is at least one vertically arranged coil spring and the guidance pin is positioned inside the coil spring.

* * * * *